US006586386B2

(12) United States Patent
Srinivas et al.

(10) Patent No.: US 6,586,386 B2
(45) Date of Patent: Jul. 1, 2003

(54) TABLET OF COMPACTED PARTICULATE CLEANING COMPOSITION

(75) Inventors: Bala Srinivas, Hasbrouck Heights, NJ (US); Purvita Patel, Hoboken, NJ (US)

(73) Assignee: ISP Investments Inc., Wilmington, DE (US)

( * ) Notice: Subject to any disclaimer, the term of this patent is extended or adjusted under 35 U.S.C. 154(b) by 0 days.

(21) Appl. No.: 10/032,618

(22) Filed: Oct. 26, 2001

(65) Prior Publication Data

US 2003/0083221 A1 May 1, 2003

(51) Int. Cl.[7] ..... C11D 17/00; C11D 3/37

(52) U.S. Cl. ..... 510/446; 510/298; 510/473; 510/475

(58) Field of Search ..... 510/446, 298, 510/473, 475

(56) References Cited

U.S. PATENT DOCUMENTS 6,329,334 B1 * 12/2001 Bertleff et al. ..... 510/445
2002/0068688 A1 * 6/2002 Callaghan et al. ..... 510/446
2002/0160930 A1 * 10/2002 Emmerson et al. ..... 510/445

FOREIGN PATENT DOCUMENTS

| | | | |
|---|---|---|---|
| DE | 10002008 | A1 * | 7/2001 |
| DE | 10002010 | A1 * | 7/2001 |
| DE | 10005017 | A1 * | 8/2001 |
| EP | 0170791 | A1 * | 12/1986 |
| EP | 0522766 | A2 * | 1/1993 |

* cited by examiner

*Primary Examiner*—Lorna M. Douyon
(74) *Attorney, Agent, or Firm*—Walter Katz; William J. Davis; Marilyn J. Maue

(57) ABSTRACT

A tablet of compacted particulate cleaning composition, wherein the tablet or a discrete region thereof contains surfactant and detergency builder, characterized by containing about 1–10% by wt. of a composite disintegrant blend comprising, by weight, (a) about 40–70% of a water soluble salt, (b) about 30–60% of a mixture of about 10–90% of cellulosic material and 90–10% of crosslinked polyvinylpyrrolidone, the tablet having a disintegration rate of at least 100 g/min.

6 Claims, 1 Drawing Sheet

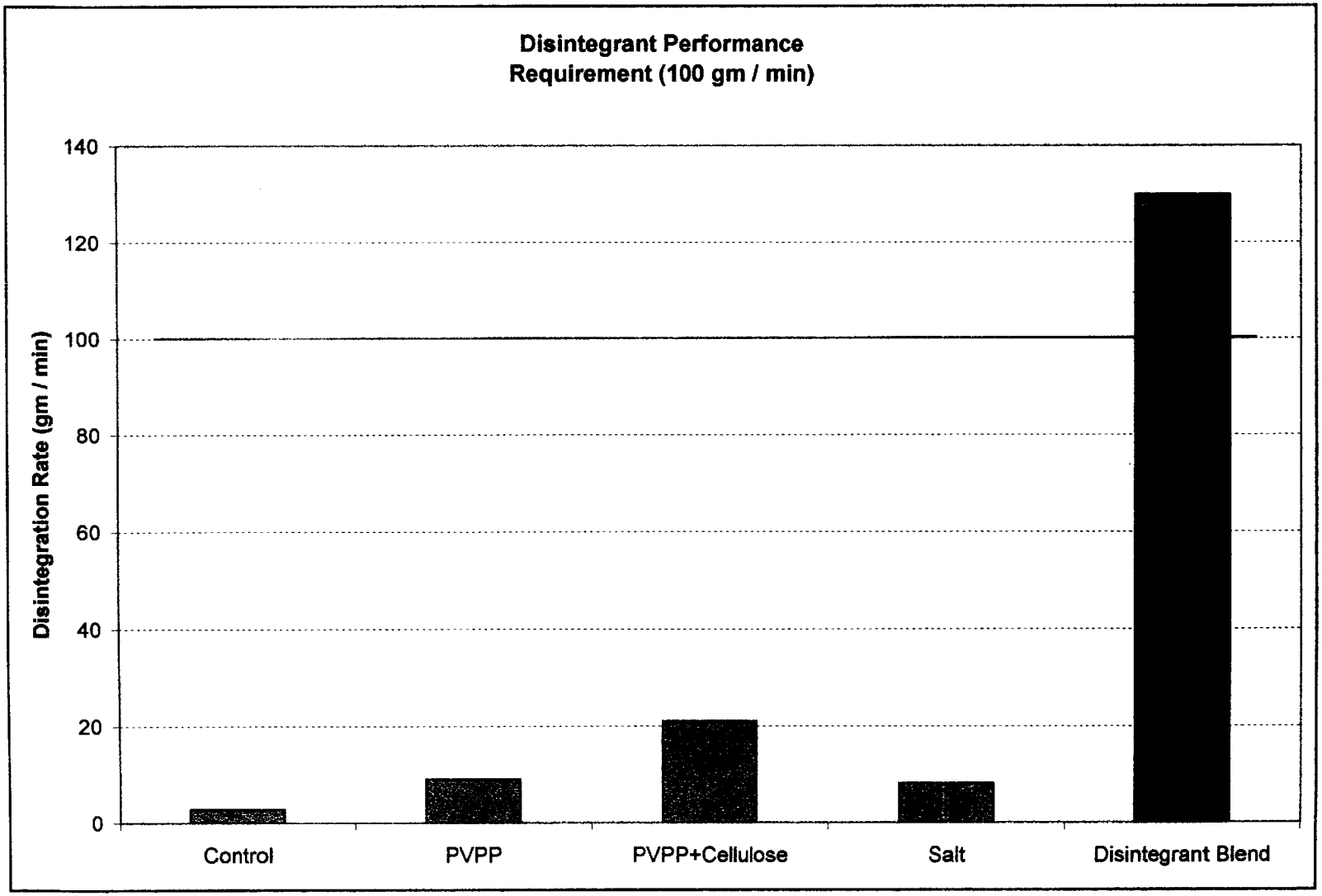
Disintegrant Performance
Requirement (100 gm / min)
Disintegration Rate (gm / min)
140
120
100
80
60
40
20
0
Control
PVPP
PVPP+Cellulose
Salt
Disintegrant Blend

TABLET OF COMPACTED PARTICULATE CLEANING COMPOSITION

BACKGROUND OF THE INVENTION

1. Field of the Invention

This invention relates to detergent compositions in the form of tablets for use in fabric washing, and, more particularly, to a composite disintegration blend of defined amounts of a water-soluble salt, a cellulosic material and crosslinked polyvinylpyrrolidone, having a disintegration rate of at least 100 g/min.

2. Description of the Prior Art

Such tablets have the advantage that they do not require the user to measure out a volume of powder or liquid. Instead one or several tablets provide an appropriate quantity of composition for washing a single load in a washing machine or possibly by hand. They are thus easier for the consumer to handle and dispense.

Detergent compositions in tablet form have been described in a number of documents and are sold commercially.

Such tablets generally are made by compressing or compacting a quantity of detergent composition in particulate form. It is desirable that tablets should have adequate mechanical strength when dry before use, yet disintegrate and disperse/dissolve quickly when added to wash water. There is difficulty in achieving both properties simultaneously. As more pressure is used when a tablet is compacted, so the tablet density and strength rise, but there is also a reduction in the speed of disintegration/dissolution when the tablet comes into contact with wash water at the time of use. Organic detergent serves as a binder, but a typical quantity of such detergent can also retard disintegration and dissolution of a tablet.

The prior art has described the numerous difficulties in providing suitable tablets of detergent compositions, including EPA 466485; WO 00/32741; EPA 711827; EPA 838519; WO 99/36493; WO 98/55583; GB 911204; U.S. Pat. No. 3,953,350; JP 60-015500A; EP-A-711827; WO 96/28530; EP 1070741; and EP 1036839.

IN THE DRAWING

The FIGURE is a bar graph of Disintegration Rate (g/min) vs. Additive Ingredient present in a standard laundry detergent formulation.

SUMMARY OF THE INVENTION

What is described herein is a tablet of compacted particulate cleaning composition, wherein the tablet or a discrete region thereof contains surfactant and detergency builder, characterized by containing about 1–10% by wt. of a composite disintegrant blend comprising, by weight, (a) about 40–70% of a water soluble salt, (b) about 30–60% of a mixture of about 10–90% of cellulosic material and 90–10% of crosslinked polyvinylpyrrolidone, said tablet having a disintegration rate of at least 100 g/min.

Preferably, in this invention, (a) is a water soluble salt; the cellulosic material in (b) is 40–60% microcrystalline or powdered cellulose, crosslinked carboxy methyl cellulose, or mixtures thereof and 40–60% crosslinked polyvinylpyrrolidone; (a) has an average particle size of at least 100 microns; and (b) has an average particle size of about 400 microns.

Suitably at least 60% by wt. of the composition is a non-soap, anionic surfactant.

DETAILED DESCRIPTION OF THE INVENTION

Constituent materials for detergent tablets will now be discussed in more detail, and various optional and preferred features will be mentioned.

Anionic Detergent Particles

The anionic detergent particles preferably comprise from 60 to 99% by weight, more preferably from 65 to 96% by weight, of anionic detergent which is one or more a non-soap organic compounds with detersive surfactant properties.

The anionic detergent may comprise, wholly or predominantly, linear alkyl benzene sulphonates where R is linear alkyl of 8 to 15 carbon atoms and $M^+$ is a solubilizing cation, especially sodium.

Primary alkyl sulphates have the formula $ROSO_3^-M^+$, in which R is an alkyl or alkenyl chain of 8 to 18 carbon atoms especially 10 to 14 carbon atoms and $M^+$ is a solubilizing cation, is also commercially significant as an anionic detergent and may be used in this invention.

Frequently, such linear alkyl benzene sulphonate or primary alkyl sulphate of the formula above, or a mixture thereof will be the desired non-soap anionic detergent and may provide 75 to 100 wt. % of the anionic non-soap detergent in the particles.

Examples of other non-soap anionic detergents which may be used include olefin sulphonates; alkane sulphonates; dialkyl sulphosuccinates; and fatty acid ester sulphonates. The anionic detergent particles may contain some nonionic detergent. The anionic detergent particles may also contain minor ingredients such as water, sodium carboxymethylcellulose, fluorescers, dyes, etc.

The anionic detergent particles may optionally contain from 0 to 40% by weight of detergency builder. The builder material may comprise soluble builder such as salts (preferably sodium salts) of tripolyphosphate, carbonate, silicate, sesquicarbonate, citrate or mixtures thereof, or burkeite (a double salt or sodium sulphate and sodium carbonate), nitrilotriacetate, polycarboxylic acid monomer, polycarboxylic acid polymer, polycarboxylic acid/maleic acid copolymer or mixtures thereof.

The builder may comprise insoluble builder such as aluminosilicate. The aluminosilicate may comprise zeolite, in particular zeolite MAP, zeolite 4A, amorphous aluminosilicate and mixtures thereof. It is particularly preferred, however, that the quantity of aluminosilicate builder is low. Preferably, aluminosilicate builder or other insoluble material provides less than 25% by weight of the anionic detergent particles, more preferably less than 15%.

The anionic detergent particles may be manufactured by mixing the components in a high speed mixer to agglomerate the components.

Processes for producing particles containing high quantities of anionic detergent are set out in WO 96/06916A and WO 96/06917A (Unilever). In these processes, an aqueous paste containing an anionic detergent, or alternatively an acid detergent precursor and also an alkaline neutralizing agent are fed into a drying zone where the paste material is heated to reduce the water content thereof, the dried material being subsequently cooled in a cooling zone to form detergent particles.

Desirably the drying zone is under a slight vacuum to facilitate the removal of water and volatiles. The vacuum may be from 100 Torr up to atmospheric pressure as this provides significant process flexibility. However, a vacuum in excess of 500 Torr up to atmospheric has the advantage of reducing capital investment while providing vacuum operation.

The process may be carried out in any suitable apparatus, but it is preferred that a flash reactor is employed. Suitable flash reactors include e.g. the Flash Drier system available from VRV Spa Impianti Industriali. The drying zone may have a heat transfer area of at least 10 $m^2$. The cooling zone desirably has a heat transfer area of at least 5 $m^2$.

The material in the cooling zone may be treated with a stream of cooling gas. Alternatively, finely divided non-detergent solid material, such as zeolite or silica particles, may be introduced into this zone to adhere to the surface of the particles. Such material may provide from 3 to 25% of the weight of the particles.

The above process routes can provide flash-dried detergent particles comprising at least 60% by weight of the particle of an anionic detergent and not more than 5% by weight of the particle of water.

These anionic detergent particles may comprise anionic detergent in an amount of at least 66% by weight of the particles, even better at least 70% but possibly not over 96%. The particles may have a porosity of from 0 to 25% by volume of the particle and a particle size distribution such that at least 80% of the particles have a particle size of 180–1500 microns. As mentioned the anionic detergent may be formed in situ by neutralization of a free acid. The neutralizing agent may be sodium hydroxide solution or sodium carbonate. However, in situ neutralization is unlikely to be appropriate when the anionic detergent is primary alkyl sulphonate (PAS) because its acid form is unstable.

All or at least a high proportion, preferably at least 50 or 80% of the anionic detergent present in the tablet or region thereof may be provided by the anionic detergent particles defined above. Alternatively, the anionic detergent particles defined above may only provide between 10 and 50% of the total anionic detergent content of the tablet or region thereof and thus act as a supplement to another source of anionic detergent, such as a base powder.

Anionic detergent particles may provide from 3% to at least 30% of the weight of the tablet or region of a tablet. The amount of them may be at least 5%, 8% or 10%. Their amount may be not over 20% of the weight of the tablet or region, especially when the particles contain at least 70 or 75% of their own weight of non-soap anionic detergent. Their amount may be not over 10% of the weight of the tablet or region, especially if the anionic detergent particles are not the only source of anionic detergent in the tablet or region thereof.

Nonionic Detergent Particles

As mentioned above, tablets of this invention will preferably include a nonionic detergent. Although some nonionic detergent may be included with the anionic detergent in the particles discussed above, we prefer to incorporate nonionic detergent as separate particles. Such nonionic detergent particles preferably comprise at least 20% of their own weight of nonionic detergent.

Such nonionic detergent particles preferably contain less than 10% by weight of anionic detergent, and preferably substantially no anionic detergent.

Nonionic detergent compounds include in particular the products obtainable by reaction of alkylene oxides, especially ethylene oxide with compounds having a hydrophobic group and a reactive hydrogen atom, for example, aliphatic alcohols, acids, amides or alkyl phenols.

Non-ethoxylated nonionic detergents include alkyl polyglycosides, glycerol monoethers, and polyhydroxy amides (glucamide).

Specific nonionic detergent compounds are alkyl ($C_{8-22}$) phenol-ethylene oxide condensates, the condensation roducts of linear or branched aliphatic $C_{8-20}$ primary or secondary alcohols with ethylene oxide, and products made by condensation of ethylene oxide with the reaction products of propylene oxide and ethylene-diamine.

Especially referred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Nonionic detergent particles suitable for use in the present invention generally fall into one of two classes.

The first class comprises nonionic detergent carried on water-soluble carrier material. Suitable carrier materials include burkeite, sodium sesquicarbonate, sodium carbonate, sodium sulphate and mixtures thereof. A nonionic detergent particle comprising water-soluble carrier preferably comprises from 20 to 50% by weight, preferably from 25 to 40% by weight, of nonionic detergent.

The water-soluble carrier material is preferably present at a level exceeding 40% by weight, preferably 60% by weight or more.

The second class of nonionic detergent particle comprises water-insoluble carrier material. The insoluble carrier material may comprise silica or aluminosilicate, such as zeolite. However, it is preferred that, if aluminosilicate is present, the quantity is less than 10% by weight. Where an insoluble carrier material is used, the quantity of nonionic detergent may exceed 50% by weight of the particle, e.g. 52% or above.

Particles containing nonionic detergent absorbed on a solid carrier material can be made by spraying the nonionic detergent onto the carrier material in a granulator or some other type of mixing apparatus.

Other materials, serving to improve the physical properties of the particles, may also be included. Such materials are frequently referred to as "structuring agents". Examples are polyethylene/polypropylene glycol of average molecular weight in the region 4,000–12,000, sodium soap, polyvinyl alcohol of average molecular weight in the range 30,000–200,000, alkaline metal succinate etc. may be present. The preferred quantity of structuring agent is in the region from 0.5 to 20% by weight. Structuring agent may be added with other ingredients or during a second granulation step. Preferred particles may contain at least 35% (of their own weight) of nonionic detergent, preferably from 40 to 55% by weight of nonionic detergent. A preferred carrier is silica having an oil absorption capacity of at least 1.0 ml/g. Oil absorption capacity is a parameter which is well known and can be measured by the technique described in DIN ISO 787/5. Preferably, the oil absorption capacity is at least 1.5 ml/g, more preferably at least 2.0 ml/g.

Preferably, there is at least 10%, more preferably at least 15% of such silica in the particles, and the quantity of silica in the particles is greater than the quantity if any, of aluminosilicate. The particles may contain less than 10% of their own weight of aluminosilicate.

Nonionic detergent particles can be manufactured by one or two step processes of mixing together components in a granulator (for example an Eirich RV02 granulator, or equipment such as the Fukae mixer from Fukae Powtech Co. of Japan, the Diosna V-series supplied by Dierks & Sohne Germany, the Pharma Matrix ex TH Fielder Ltd England, the Lodige CB series and the Drais T160 series fro Drais Werke, GmbH, Mannheim, Germany).

Nonionic detergent particles preferably have mean particle size in a range from 200 to 2,000 $\mu$m such that at least 80% of these particles have a particle size in the range from 180 to 2,000 μm. All or at least a high proportion, at least 50% or 80%, of the nonionic detergent present in the tablet or region thereof may be provided by the nonionic detergent particles defined above. Alternatively, the nonionic detergent particles defined above may only provide between 10 and 50% of the total nonionic detergent content of the tablet or region thereof and thus act as a supplement to another source of nonionic detergent, such as a base powder.

Nonionic detergent particles may provide from 2 or 3 to 30% of a tablet or a region of a tablet. Such particles may constitute from 8 to 20% of a tablet, more especially if these particles contain at least 40% of nonionic detergent. Their amount may be not over 8 to 10% of the weight o the tablet or region, especially if the nonionic detergent particles are not the only source of nonionic detergent in the tablet or region thereof.

Other classes of organic detergent, such as amphoteric detergent, may be included but are not preferred. It is desirable that all or substantially all e.g. at least 90% by weight of all non-soap organic detergent is contained in the said particles (A) which contain anionic detergent or in other particles which contain at least 20% of their own weight of non-anionic, non-soap organic detergent.

A tablet wherein the cleaning composition contains one or more substances from the group of bleaching activators, enzymes, pH adjusting agents, fragrances, perfume carriers, fluorescence agents, dyes, foam inhibitors, silicone oils, antiredeposition agents, optical brighteners, graying inhibitors, color transfer inhibitors, and corrosion inhibitors.

Disintegration Enhancing Particles

In accordance with this invention, a constituent of the component blend of the tablet which serves to accelerate tablet disintegration in water is a water soluble material.

Accordingly, the first component of the composite disintegration aid is (a) a highly water-soluble material, especially salts in an amount of about 40–70% by weight of the composite.

Suitably, the water soluble salt has a solubility at 20° C. of at least 50 g per 100 g of water. A solubility of at least 50 g per 100 g of water at 20° C. is an exceptionally high solubility: many materials which are classified as water soluble are less soluble than this.

Some highly water-soluble materials which may be used are listed below, with their solubilities expressed as grams of solid to form a saturated solution in 100 g of water at 20° C.

| Water-Soluble Material | Water Solubility (g/100 g) |
|---|---|
| Sodium citrate dihydrate | 72 |
| Potassium carbonate | 112 |
| Urea | >100 |
| Sodium acetate, anhydrous | 119 |
| Sodium acetate trihydrate | 76 |
| Magnesium sulphate $7H_2O$ | 71 |
| Potassium acetate | >200 |

Preferably, this highly water soluble material is incorporated as particles of the matrix in a substantially pure form, in an amount of 40–70% of the disintegrant blend. Urea is a preferred water-soluble material, most preferably with an average particle size of at least 100 microns.

The second component (b) of the disintegrant blend blend of the invention is present in an amount 30–60% of the blend. The second component (b) is a mixture of a cellulosic material, 10–90% of the mixture and polyvinylpyrrolidone (PVPP), 90–10% by weight, of the mixture. Most preferably, the mixture has an average particle size of about 400 microns.

Composition of Disintegration Blend

| | Wt. % |
|---|---|
| Standard Laundry Detergent | 95 |
| Disintegrant Blend | 5 |
| (a) Urea | 3 |
| (b) Cellulosic | 1 |
| +PVPP | 1 |

The tablets of the invention herein have a disintegration rate of at least 100 g/min (based on a 40 g tablet), usually at least 120 g/min. The FIGURE is a bar graph which shows advantageous results, in which the tablet formulation herein, referred to in the FIGURE as the "Distintegrant Blend" of the composition above has a disintegration rate of 130 g/min, whereas the control (without blend) is essentially zero; and other additives such as PVPP, or PVPP/cellulose or urea (salt) have only minimal disintegration rates, particularly 20 g/min or below. These results demonstrate the unexpected and significantly advantageous benefits achieved by incorporating the additive blend of the invention into laundry detergent compositions, and of its practical and economic benefits for the consumer.

While the invention has been described with particular reference to certain embodiments thereof, it will be understood that changes and modifications may be made which are within the skill of the art.

Accordingly, it is intended to be bound only by the following claims, in which:

1. A tablet of compacted particulate cleaning composition, wherein the tablet contains anionic detergent particles comprising detergent builder and at least 60% by wt. of the particles, of a non-soap, anionic surfactant, characterized by containing about 1–10% by wt. of a composite disintegrant blend comprising, by weight, (a) about 40–70% of a water soluble salt, (b) about 30–60% of a mixture of about 10–90% of cellulosic material and 90–10% of crosslinked polyvinylpyrrolidone, said tablet having a disintegration rate of at least 100 g/min.

2. A tablet according to claim 1 wherein (a) is a water-soluble salt having a solubility of at least 50 g per 100 g of water at 20° C.

3. A tablet according to claim 1 wherein the cellulosic material (b) is microcrystalline or powdered cellulose, crosslinked carboxy methyl cellulose, or mixtures thereof.

4. A tablet according to claim 1 wherein (a) has an average particle size of at least 100 microns.

5. A tablet according to claim 1 wherein (b) has an average particle size of about 400 microns.

6. A tablet according to claim 1 wherein the cleaning composition contains one or more substances selected from the group consisting of bleaching activators, enzymes, pH adjusting agents, fragrances, perfume carriers, fluorescence agents, dyes, foam inhibitors, silicone oils, antiredeposition agents, optical brighteners, graying inhibitors, color transfer inhibitors, and corrosion inhibitors.

* * * * *